US007108610B1

(12) United States Patent
Florian

(10) Patent No.: US 7,108,610 B1
(45) Date of Patent: Sep. 19, 2006

(54) SWING TRAINING DEVICE

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 11/185,133

(22) Filed: Jul. 21, 2005

(51) Int. Cl.
*A63B 69/36* (2006.01)

(52) U.S. Cl. ..... 473/267; 473/266

(58) Field of Classification Search ..... 473/219, 473/257, 266, 267, 268, 269
See application file for complete search history.

(56) References Cited

U.S. PATENT DOCUMENTS 3,611,591 A * 10/1971 Light ..... 434/252
3,986,719 A * 10/1976 Lee ..... 473/197
4,083,559 A 4/1978 Owen, Jr.
4,383,687 A 5/1983 Wolff
5,015,084 A 5/1991 Kryder
5,174,566 A 12/1992 Kelnhofer
5,174,576 A 12/1992 Lee et al.
5,270,871 A 12/1993 Florian
5,348,304 A 9/1994 Meade
5,603,617 A * 2/1997 Light ..... 434/252
5,971,766 A * 10/1999 Guiney ..... 434/252
6,422,956 B1 7/2002 Kusmiss

* cited by examiner

*Primary Examiner*—Nini F. Legesse
(74) *Attorney, Agent, or Firm*—Charles W. Chandler; Steve M. Clemmons

(57) ABSTRACT

The present invention provides for a swing training device for golfers which allows a golfer to receive immediate visual feedback as to his stance, form, and technique. The training device includes a break-resistant mirror and long support legs mounted behind the reflective surface. These legs not only support the mirror in an upright position, but act as shock absorbers so that the golfer can repeatedly hit practice balls or throw a weighted training ball into the mirror. The legs deflect and then spring back, thereby reorienting the mirror back to its original position and allowing the golfer to remain in substantially the same location while training.

19 Claims, 6 Drawing Sheets

SWING TRAINING DEVICE

BACKGROUND OF THE INVENTION

This invention relates to a training device for improving a person's golf swing. This invention develops a golfer's muscle memory by providing immediate visual feedback to the golfer before, during, and after each swing. This feedback is through a reflective surface which is disposed in front of the golfer. This invention further develops the golfer's muscle memory through a support frame which permits the golfer to repeatedly strike golf balls (either practice or regulation balls) or throw a medicine ball directly at the reflective surface.

Success at golf (or any other sport or activity involving the striking of a projectile) depends upon a golfer's ability to repeatedly swing his club in exactly the same manner. Such repetition develops muscle memory (i.e., a muscle's ability to perform an action without conscious thought by the person as to how such an action is accomplished). If the repetitions are done using good golf form and technique, then good muscle memory is developed.

Furthermore, if a golfer receives feedback on his form and technique during his swing, then good muscle memory may be developed and the improvement of his swing is greatly enhanced.

Still further, muscle development is enhanced by weight-training exercises. In golf, the muscles associated with swinging a golf club can be exercised using a weighted ball or "medicine ball." The medicine ball replaces the golf club during a swing to add resistance and thereby increase the work performed by the swing muscles. Oftentimes, it is desirable to release the medicine ball near the end of the swing to ensure the golfer does not lose his balance during the follow-through or end phase of the swing.

Some prior art references pertaining to reflective swing development devices include U.S. Pat. No. 6,422,956 issued Jul. 23, 2002 to John H. Kusmiss for "Apparatus For Practicing A Ball-Propelling Sport Using A Ball-Returning Device In Conjunction With An Imaging Device"; U.S. Pat. No. 5,348,304 issued Sep. 20, 1994 to John C. Meade for "Golf Club Swing Training Method"; U.S. Pat. No. 5,270,871 issued Dec. 14, 1993 to the present inventor for "Stand Up Practice Mirror"; U.S. Pat. No. 5,174,576 issued Dec. 29, 1992 to Kevin S. Lee et al. for "Portable Golf Practice Mirror"; U.S. Pat. No. 5,174,566 issued Dec. 29, 1992, to George L. Kelnhofer for "Training Device For Golfers"; U.S. Pat. No. 5,015,084 issued May 14, 1991 to Ralph H. Kryder for "Sports Training Apparatus Including A Mirror Assembly With Adjustable Line Segments"; U.S. Pat. No. 4,383,687 issued to Claude Wolff for "Reflecting Device For Golf Training Or Any Other Sport Using A Ball Striking Staff"; and U.S. Pat. No. 4,083,559 issued Apr. 11, 1978 to George Owen, Jr. for "Sports Training Apparatus".

Generally such prior art fails to provide for a swing development device which allows the user to receive visual feedback while developing muscle memory through repeated practice swings (either striking balls or resistance training) that cause the training aid to temporarily deflect then return to its original position.

SUMMARY OF THE INVENTION

The broad purpose of the present invention is to provide a golf swing feedback device comprising a planar mirrored surface which is supported by a pair of "L-shaped" legs mounted behind the mirror. The mirror and the legs are both mounted upon a base. The bottom of the mirror is placed within a channel in the base and one end of each of the legs is fitted within an aperture in the base. The other ends of the legs are mounted to the upper portion of the mirror.

When a golfer hits balls or throws a weighted ball into the mirror, the legs operate as "shock absorbers" by elastically deforming then rebounding to their original location to position the mirror back into alignment relative to the golfer.

A net mounted upon a removable frame is also provided wherein the frame is mounted to the mirror so that the net is placed between the golfer and the mirror. The net allows the golfer to hit regulation-type golf balls at the mirror and also assists beginning golfers to capture miss-hit practice balls that may not have struck the mirror.

A ball return ramp is also provided which may be mounted to the base in front of the mirror. This ramp is placed at an angle sloping away from the mirror allowing the balls hit or thrown into the mirror to roll down its top surface toward the user.

Still further objects and advantages of the invention will become readily apparent to those skilled in the art to which the invention pertains, upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
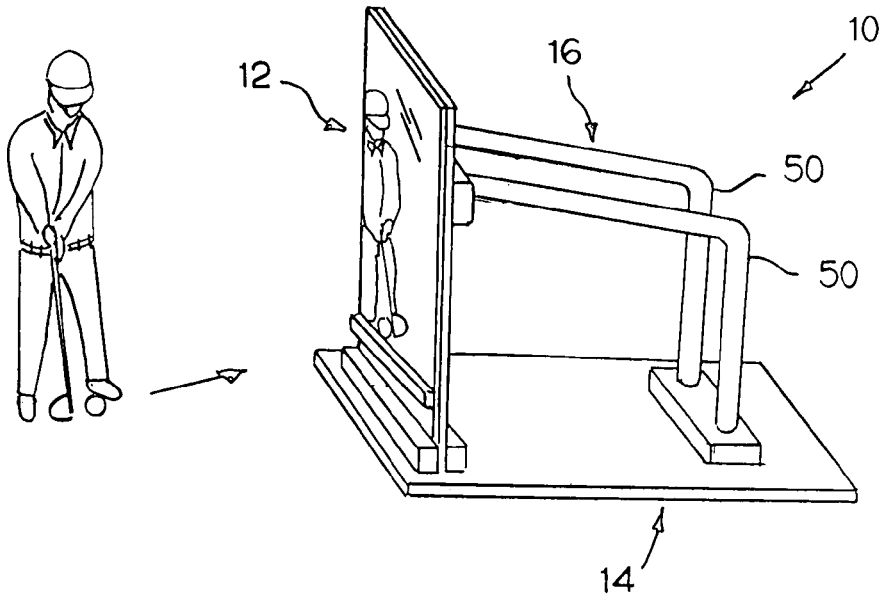
FIG. 1 is a perspective view of a swing training aid illustrating the preferred embodiment of the invention including: a mirror assembly, a base, and a support frame assembly.

Referring to the drawings, FIG. 1 illustrates a preferred swing training aid 10. Swing training aid 10 includes an planar reflective surface or mirror assembly 12, a base member 14, and a support frame assembly 16.

Figure 2:
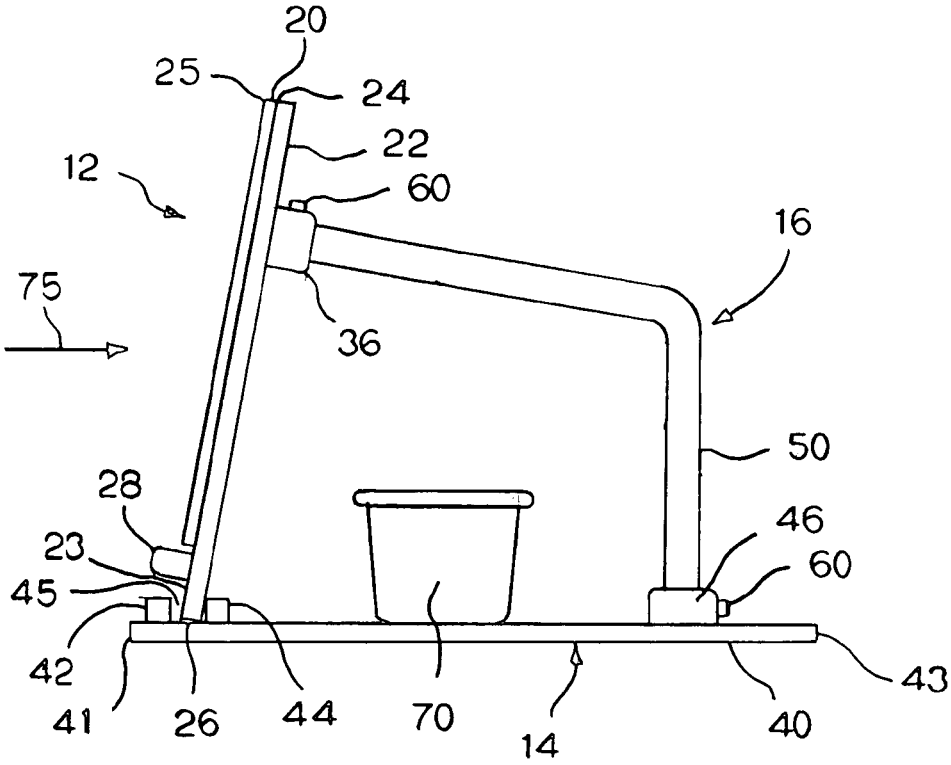
FIG. 2 is a side view of the preferred embodiment of the invention.
Figure 3:
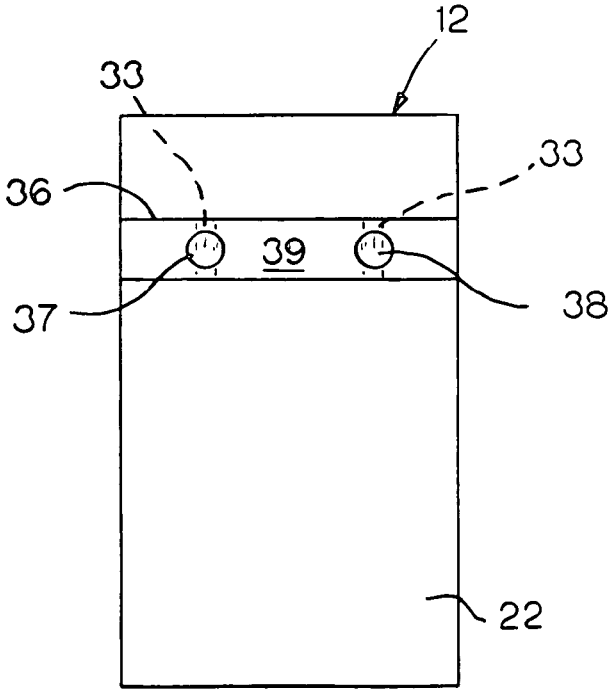
FIG. 3 is a back view of the mirror assembly.

As shown in FIGS. 1, 2, and 3 mirror assembly 12 is a generally planar mirror having a break resistant front and a strong backing. Mirror assembly 12 includes a clear protective front layer 20 and a reflective surface 24 fixedly mounted to a backing layer 22. Particularly, front layer 20 is formed from a clear relatively break and wear resistant material such as a acrylic sheet material sold by the Atofina Corporation of Puteaux, France under the trademark PLEXIGLAS. A layer of reflective or "silvered" material 24 is deposited upon or abuttingly disposed against front layer 20 to create a reflective surface or mirror. The backing layer 22 is formed from a relatively resilient and lightweight material, such as wood or plastic.

In the preferred embodiment of the invention, mirror assembly 12 is generally rectangular in shape being four feet (1.22 m) in length and two feet (0.61 m) wide. The front acrylic layer 20 is approximately one eighth inches (3.18 mm) thick and backing layer 22 is approximately three eighths inches (9.53 mm) thick, making the entire mirror assembly 12 about one half inch (1.27 cm) thick.

As shown best in FIG. 2, the acrylic front layer 20 and reflective layer 24 do not cover the entire length of the backing layer 22. Instead, a portion 23 of layer 22 extending approximately six inches (15.24 cm) up from its bottom edge 26 is not covered by either layer 20, 24.

Mirror assembly 12 also includes an accessory rail 28 that is fixedly coupled to the exposed front side 23 of the backing layer 22 beneath the acrylic layer 20. Rail 28 extends across the width of the backing layer 22 running parallel to bottom edge 26. In the preferred embodiment of the invention, rail 28 is approximately one inch (2.54 cm) square and is about eighteen inches (45.72 cm) long and is formed from a strong material such as wood or plastic.

Mirror assembly 12 also includes a frame support block 36 which is fixedly coupled to the back side of backing layer 22 in close proximity to the top edge 25 of the mirror assembly. As shown, block 36 runs lengthwise across the width of backing layer 22 substantially parallel to edge 25.

Block 36 further includes a pair of support frame holes 37, 38. Holes 37, 38 are formed within block 36 substantially perpendicular to the outer surface 39 of block 36. These holes 37, 38 are spaced apart a distance equal to approximately one half of the length of the block 36 and are centered along its width. These holes 37, 38 are sized to receive and retain the outer diameter of the support frame members described below. In the preferred embodiment of the invention, block 36 is generally rectangular being two inches (5.08 cm) thick by four inches (10.16 cm) wide and is approximately two feet (1.22 m) long. Further, holes 37, 38 are approximately one inch (2.54 cm) in diameter and are approximately two inches (5.08 cm) in depth. In this preferred embodiment, block 36 is located approximately six inches (15.24 cm) from top edge 25 of mirror assembly 12

In an alternative embodiment, two additional fastener holes 33 are formed in block 36. Each of these holes 33 is formed perpendicular to and intersects is with one of the support holes 37, 38. These holes 33 are located approximately one inch (2.54 cm) from the outer surface 39 and run generally parallel to the length of the backing layer 22.

Figure 9:
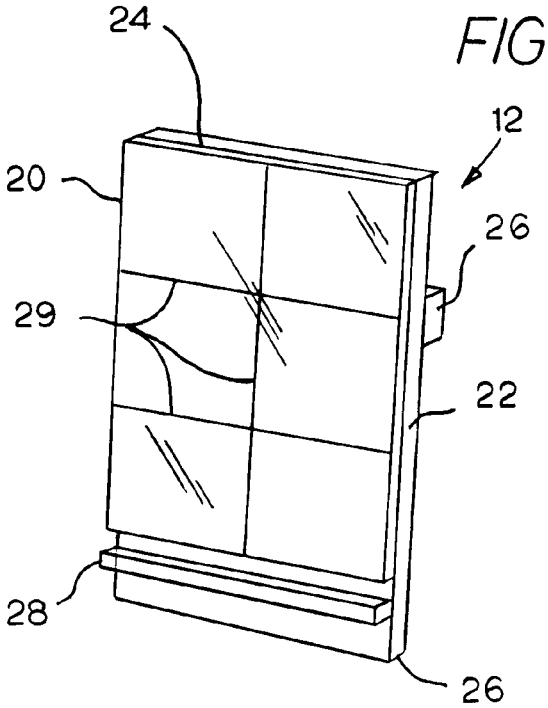
FIG. 9 is a perspective view of yet another embodiment of the invention illustrating the mirror assembly having alignment lines.

In one non-limiting embodiment, shown in FIG. 9, mirror assembly 12 may further include at least one alignment lines or markers 29 located upon either the front layer 20 or the reflective layer 24. These lines 29 are located upon mirror assembly 12 in a way to provide visual cues or markers upon which a golfer may align his stance, swing plane, and/or follow-through position.

Figure 10:
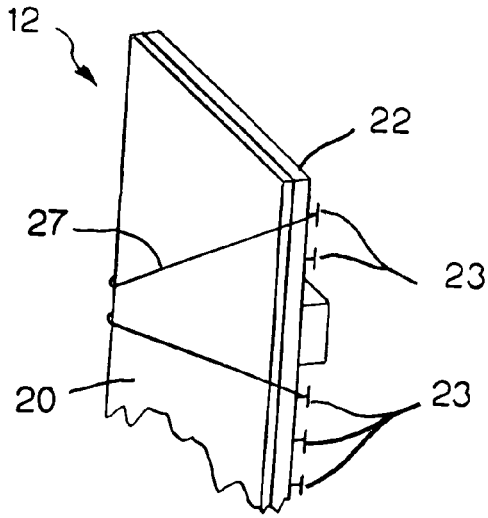
FIG. 10 is a partial perspective view of still yet another embodiment of the invention illustrating the mirror assembly having a plurality of hooks and strings to produce alignment lines.

In another embodiment shown in FIG. 10, mirror assembly 12 is substantially the same as it is described above, but also includes a plurality of tie down points or hooks 23 along the outer edges and running the length of the backing layer 22. A user of mirror assembly 12 may then position strings 27 across the front of layer 20 and removably couple the ends of the strings 27 to any of the provided tie-downs 23. In this embodiment of the invention, the strings 27 may replace or supplement the permanent lines 29 formed in the mirror described in the above embodiment. In this manner, a user may customize any number of alignment markers to best suit his training needs.

Figure 4:
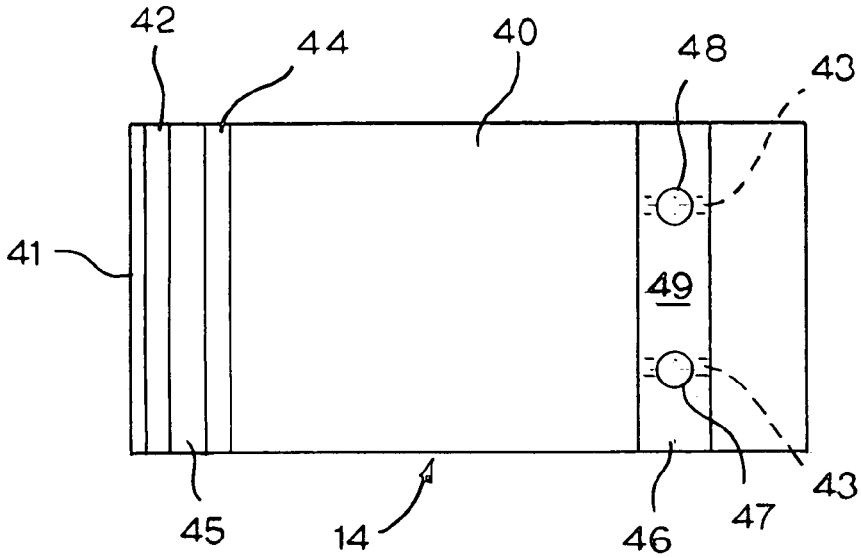
FIG. 4 is a top view of the base member.

Referring now to FIGS. 2 and 4, training aid 10 also includes a base portion 14 Base portion 14 provides a broad and stable surface upon which the mirror assembly 12 is mounted. Base 14 includes a generally planar bottom or baseboard 40.

Base portion 14 also includes a pair of substantially identical mirror support rails 42, 44. These rails 42, 44 are fixedly coupled upon the upper surface of baseboard 40 in close proximity to front end 41 of baseboard 40. As shown, rails 42, 44 run substantially parallel to edge 41 and cooperate with baseboard 40 to define a generally "U-shaped" channel 45 that traverses the width of baseboard 40. In an alternate embodiment of the invention, rails 42, 44 are replaced by a notch or crevice formed along the width of the baseboard 40.

In the preferred embodiment, baseboard 40 is generally rectangular in shape being approximately four feet (1.22 m) in length and two feet (0.61 m) in width. Baseboard 40 is approximately one half inch (1.27 cm) thick and is formed from a relatively stiff and resilient material such as wood or plastic. In this preferred embodiment of the invention, rails 42, 44 are approximately one inch (2.54 cm) square and are approximately two feet (1.22 m) long. In this preferred embodiment, rail 42 is disposed approximately one inch (2.54 cm) from front edge 41, while rail 44 is disposed approximately one half inch (1.27 cm) from rail 42.

Base portion 14 also includes a frame support block 46. Block 46 is fixedly coupled to the upper surface of baseboard 40 and is located a distance from back edge 43 equal to approximately one-quarter the length of baseboard 40. As shown, block 46 runs lengthwise across the width of baseboard 40 substantially parallel to edge 42. In the preferred embodiment of the invention, block 46 is generally rectangular being two inches (5.08 cm) thick by four inches (10.16 cm) wide and is approximately two feet (1.22 m) long.

Block 46 also includes a pair of support frame holes 47, 48. Holes 47, 48 are formed within block 46 substantially perpendicular to the outer surface 49 of block 36. These holes 47, 48 are spaced apart a distance equal to approximately one half of the length of the block 46 and are centered along its width. These holes 47, 48 are sized to receive and retain the outer diameter of the support frame members described below. In the preferred embodiment of the invention, holes 47, 48 are approximately one inch (2.54 cm) in diameter and are approximately two inches (5.08 cm) in depth.

In an alternative embodiment of the invention, two additional holes 43 are formed in block 46. Each of these holes 43 is formed perpendicular to and intersects with one of the support holes 47, 48. These holes 43 are located approximately one inch (2.54 cm) from the top surface 49 and run generally parallel to the length of the baseboard 40. In this preferred embodiment, block 46 is located approximately one foot (0.30 m) from back edge 43 of baseboard 40.

Figure 5:
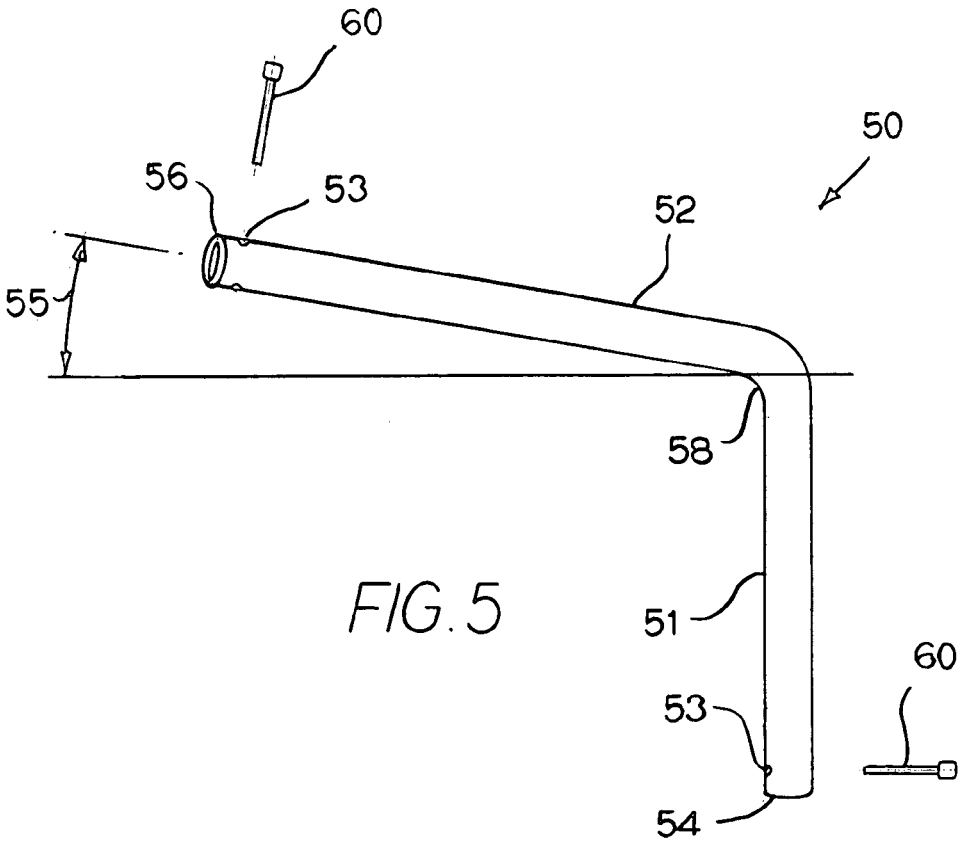
FIG. 5 is a perspective view of a frame member of the frame assembly.

As best shown in FIGS. 1 and 5, swing training aid 10 includes a support frame assembly 15. Support frame assembly 16 includes a pair of identical tubular frame members 50. Each frame member 50 includes two elongated leg portions 51, 52 which are coupled together to give each frame member 50 a generally "L-shaped" configuration. First leg portion 51 is coupled to second leg portion 52 at an elbow 58. When training aid 10 is assembled, first leg portion 51 is oriented vertically while second leg portion 52 is oriented generally horizontally. As shown, portion 52 is coupled to portion 51 at a slight angle 55 relative to the horizontal plane. In the preferred embodiment of the invention angle 55 is between zero and twenty degrees.

In the preferred embodiment of the invention, each member 50 is formed from approximately one inch (2.54 cm) outside diameter plastic pipe material (i.e., three fourths inch (1.91 cm) inside diameter pipe). In one form, portion 51 is approximately thirty-two inches (0.81 m) long and portion 52 is approximately three feet (0.91 m) long.

Each frame member 50 also has a hole 53 formed in each portion 51, 52 approximately one inch (2.54 cm) from the terminating ends 54, 56. The holes 53 are oriented so that the hole formed in end 56 is parallel to portion 51 lengthwise while the hole formed in end 54 is parallel to portion 52 lengthwise.

In the preferred form, each frame member 50 is formed from polyvinyl chloride material, commonly known as PVC. PVC material is used as it is relatively rigid, lightweight, and resistant to breaking. Schedule 40 PVC pipe is provided in the preferred embodiment of the invention, but other schedules of PVC pipe may be used.

The two frame members 50 are fitted within the holes 37, 38, 47, 48 formed in blocks 36, 46. That is, end 56 is fitted within hole 37 while end 54 is fitted into hole 47. Similarly, end 56 of the other frame member 50 is fitted within hole 38 while its end 54 is fitted into hole 48. The bottom edge 26 of mirror assembly 12 is placed within the U-shaped channel 45 of the base 14. In this manner, mirror assembly 12 is solidly supported by the frame assembly 16 and the base 14.

Figure 1A:
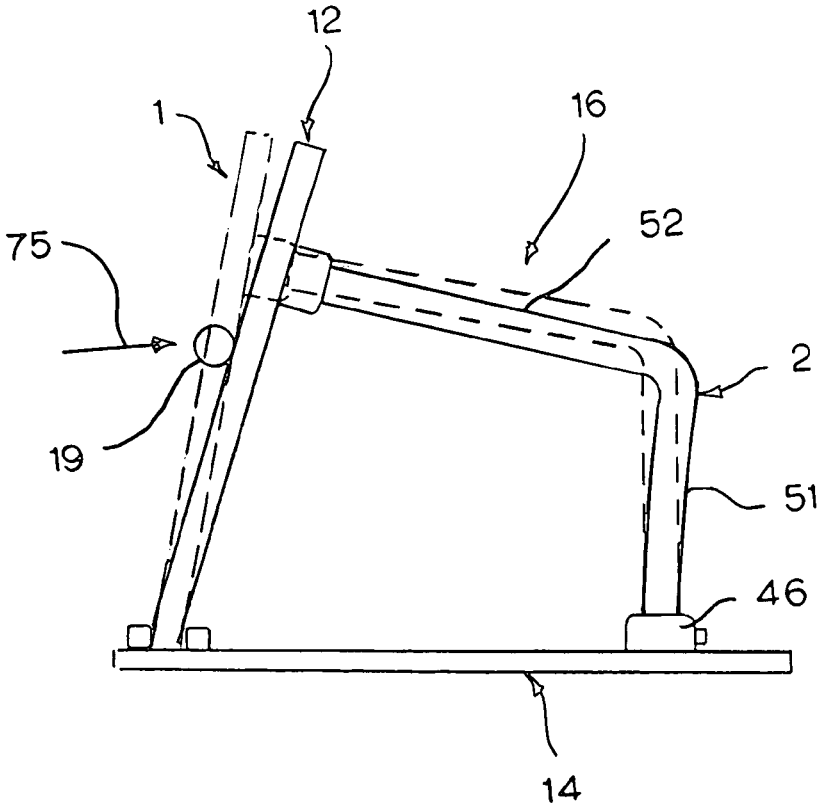
FIG. 1*a* is a side view of the preferred embodiment of the invention illustrating the deflection of the frame assembly and the mirror assembly.

Moreover, as shown in FIG. 1*a*, frame assembly 16 in cooperation with base 14 operates as a shock absorber when forces are applied against the mirror assembly 12 in the general direction of arrow 75. That is, when a force is applied against the mirror assembly 12 (e.g., a ball 19 striking the mirror assembly 12), that force is transferred through portion 52 and elbow 58 to portion 51. The long length of portion 51 relative to its diameter permits a limited amount of elastic deformation or temporary bending to occur along leg portion 51 while the force is applied. This limited deformation results in the mirror assembly 12 and frame assembly 16 being moved from its original position 1 (shown in shadow) to a second shock absorbing position 2.

After the force is removed (i.e., after the ball 19 has impacted the front surface 20 and has dropped to the ground), the configuration and placement of frame members 50 inherently causes the mirror assembly 12 to be reoriented back to its original position. In this manner, the mirror assembly 12 is repositioned in the same location relative to a user after each force is applied then removed (ball hitting the mirror).

In the preferred embodiment of the invention, training aid 10 also includes four fasteners or pin members 60. Each pin 60 is adapted to fit within the holes 33, 43, 53. The pin members 60 removably couple the frame members 50 to the base 14 and mirror assembly 12. That is, a pin member 60 is fit into the hole 33 formed in block 36 and through the hole 53 formed through the end 56 of a frame member 50. This procedure is similarly repeated for each hole 33, 43 formed in the blocks 36, 46 until each end 53, 54 of the frame members 50 are pinned into place. In another embodiment, each of the ends 54, 56 are press-fit into their respective holes 37, 47.

Figure 11:
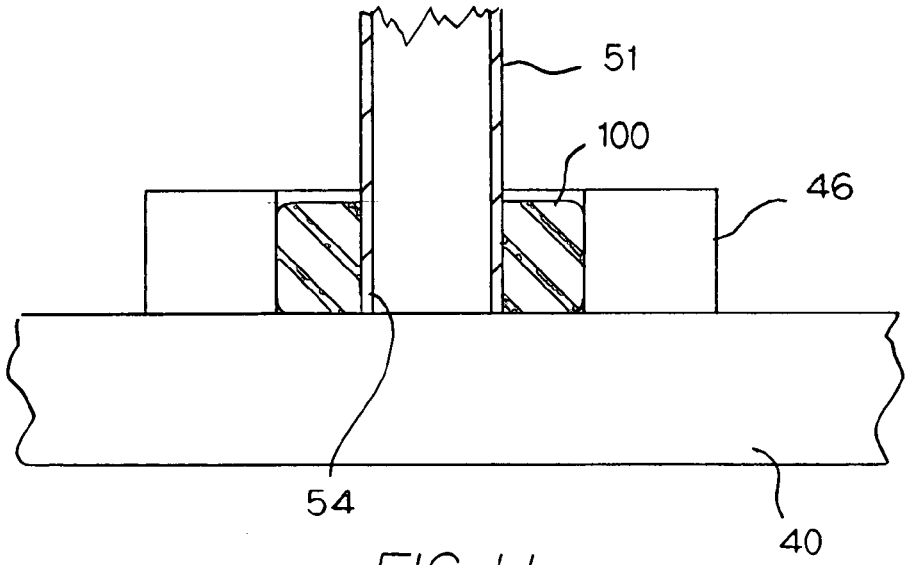
FIG. 11 is a side cut-away view of still yet another embodiment of the invention illustrating the base member having a cushioning grommet.

In an alternative embodiment of the invention shown in FIG. 11, two rubber grommets 100 sized to fit around the outer diameter of ends 54 are also included. These grommets 100 are fit into holes 47, 48 which have been enlarged to accommodate the addition of the grommets 100. These grommets 100 increase the ability of the frame assembly 16 to deflect while reducing the amount of stress applied to the block 46 and ends 54 when a force is applied to the mirror assembly 12.

In operation, a user of the training aid 10 stands in front of mirror assembly 12 so that he may see his reflection in mirror assembly 12. The user may then view his swinging motion in the mirror assembly 12. The user may also strike practice golf balls or use weighted medicine balls in his swinging regimen to enhance his training. The user may then hit or throw these balls into the mirror assembly 12 to develop his muscles and muscle memory, while also view himself in the mirror assembly 12 to receive immediate visual feedback as to his stance and swing technique.

The rebound effect provided by the frame assembly 16 after a force is applied by the user (i.e., after the user hit or threw a ball at the training aid 10) allows the user to remain standing in substantially the same location while training. This beneficially eliminates the user's need to reposition himself to best see his reflection in the mirror assembly 12 after each swing. This is because the frame assembly 16 causes the reflection off of the reflective surface 24 to be substantially the same as it was before the user made his previous swing. This repeatable rebound effect is particularly useful when the mirror assembly employs the alignment markings 27, 29 to assist in his training. This is because the user may align the reflection of certain body parts with a particular line 27, 29 each time he swings. By returning to the same relative position after being struck, the mirror assembly 12 of training aid 10 enables the user to re-align himself with these lines 27, 29 quickly and easily.

If the user desires to apply a large amount of force upon the training aid 10 (such as using a heavy medicine ball), then the relatively open configuration of the mirror assembly 12, frame assembly 16, and base 14 allows a weight 70 to be placed upon the baseboard 40 beneath the horizontal portions 52 of the frame members 50. In one non-limiting embodiment, the user may place his golf bag in this location in addition to or in place of weight 70.

Figure 12:
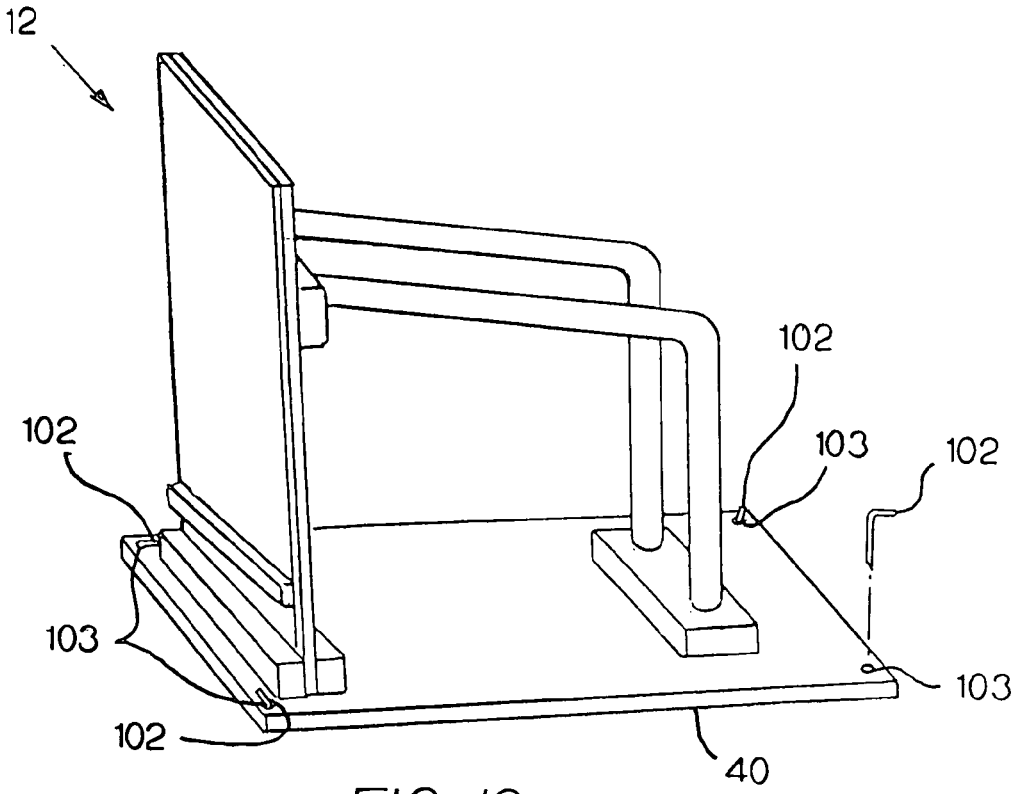
FIG. 12 is a perspective view of still yet another embodiment of the invention illustrating hold down stakes securing the base member to the ground.

In an alternative embodiment of the invention shown in FIG. 12, four hold-down stakes 102 are also included. These stakes 102 can be inserted through staking holes 103 which are formed in the corners of baseboard 40 and into the ground to secure the base portion 14 to a certain location.

Figure 6:
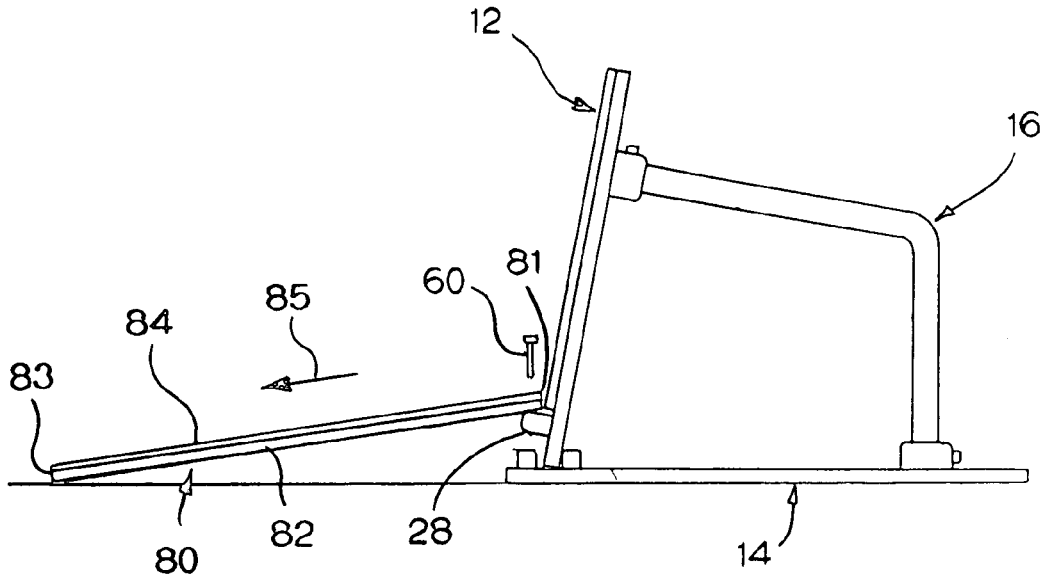
FIG. 6 is a side view of an alternative embodiment of the invention having a ball return ramp.

Referring now to FIG. 6, an alternative embodiment of the invention is shown wherein the training aid 10 also includes a ball return ramp 80. Ball return ramp 80 is removably coupled to the front of mirror assembly 12 through conven tional fasteners, such as pins 60 or complementary nuts and bolts.

Ramp 80 includes a board member 82 and a covering 84. In the preferred alternate embodiment, covering 84 is a green artificial turf material which covers the top surface of member 82. End 81 of ramp 80 is disposed upon the top surface of the accessory rail 28 and is removably coupled to rail 28 using fasteners 60 in a conventional manner. The opposing end 83 is placed upon the ground resulting in a surface which declines from an elevated position at the point where the member 82 is coupled to the rail 28 to the ground. Board member 82 is generally rectangular being approximately three feet (0.91 m) in length and two feet (0.61 m) in width. Member 82 is approximately one quarter inch (6.4 mm) thick and is formed from a relatively resilient and lightweight material such as wood or plastic.

In operation, the user of training aid 10 stands in front of the ramp 80 and mirror assembly 12, positioning himself in the manner described above. When the user hits or throws a ball into the mirror assembly 12, the ball will first drop down upon the ramp 80 and will roll along the ramp 80 toward edge 83 and the ground. In this manner, a user of training aid 10 can have the balls he is using in his training returned to him by the ramp 80. Cover 84 provides a uniform and "grass-like" foreground to reduce any distractions in the user's peripheral vision while addressing the ball prior to a swing. The artificial turf of cover 84 also acts to slow a golf ball from rolling too far past the user.

Figure 7:
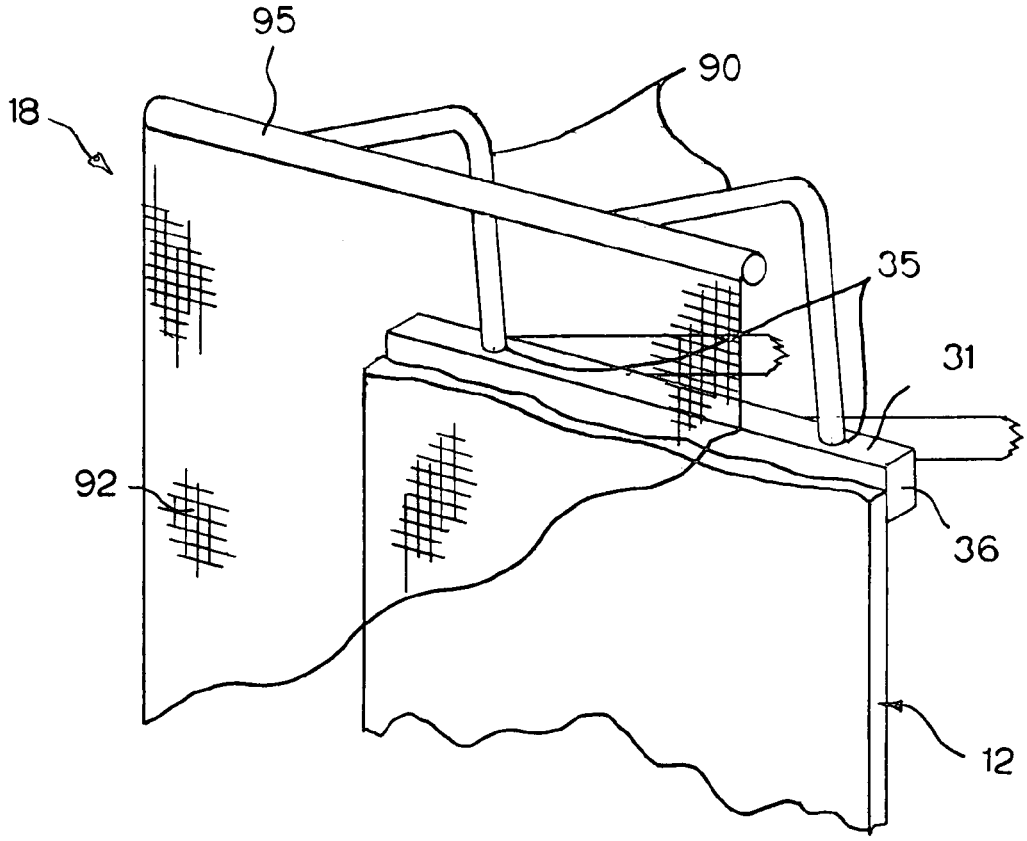
FIG. 7 is a partial perspective view of another embodiment of the invention illustrating a net assembly coupled to the swing training aid.
Figure 8:
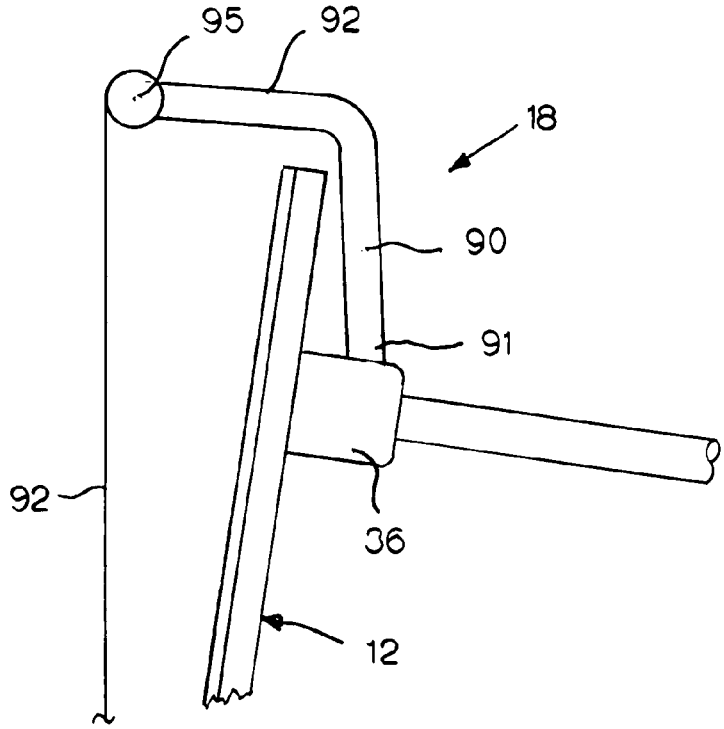
FIG. 8 is a partial side view of the embodiment shown in FIG. 7.

Referring now to FIGS. 7 and 8, another alternative embodiment of the invention is shown. In this embodiment, the training aid 10 described above also includes a net assembly 18. Net assembly 18 includes a net 92, a crossbar 95, and a pair of uprights 90 which are removably mounted to the support block 36 of the mirror assembly 12.

Particularly, uprights 90 are generally L-shaped tubular supports having a first vertical portion 91 and a second horizontal portion 92. A long tubular crossbar 95 is removably coupled to each upright 90 at the end of portion 92 using conventional fasteners.

In the preferred alternative embodiment, uprights 90 and crossbar 95 are formed from the same material and are the same diameter as the frame members 50 of frame assembly 16. Vertical portion 91 is approximately three feet (0.91 m) in length and horizontal portion 92 is approximately 18 inches (0.46 m) in length. Crossbar 95 is approximately four feet (1.22 m) in length.

In this non-limiting embodiment, support block 36 has two additional mounting holes 35 formed in its top surface 31. These holes 35 are sized to receive and retain the outer diameter of portion 91 of the two uprights 90. Additional conventional fastening means (not shown), similar to pin members 60, may be used to secure the uprights to the support block 36. In this embodiment, holes 35 are located approximately two inches (5.08 cm) from the outermost edges of the block 36.

Net 92 is coupled to and runs the length of crossbar 95. Net 92 is a relatively fine mesh net allowing a user to easily see through the net 92, while effectively stopping the intended projectiles (e.g., golf balls) from passing through. Net 92 is generally rectangular in shape being approximately four feet (1.22 m) wide and six feet (1.83 m) in length. This length allows net 92 to hang from crossbar 95 down to the ground.

As shown, net 92 is located between the user and mirror assembly 12 and allows a user to hit standard golf balls toward the training aid 10 without the worry of ricochet or accidental miss-hit balls going past the training aid 10. Using standard golf balls also provides the positive training feedback of feel (i.e., feeling the impact associated with hitting golf balls used on the golf course). Net assembly 18 allows the user to experience this tactile feedback while still providing the immediate visual feedback provided by mirror assembly 12.

It should be appreciated that substantially any of the embodiments described herein can be combined to provide the user of training aid 10 with a number of training options. For example and without limitation, the ball return ramp 80 shown in FIG. 6 could cooperatively used with the alignment lines 29 shown in FIG. 9 and the net assembly 18 shown in FIGS. 7 and 8 to allow the user to use the alignment cues provided by the lines 29 while benefiting from the net 92 to hit standard golf balls into the training aid 10 and having the golf balls roll back to him via the ball return feature of ramp 80.

It should further be appreciated that the mirror assembly 12, base portion 14, and frame assembly 16 (as well as the ramp 80 and net assembly 18 shown in the alternative embodiments), can each be quickly and easily separated from each other to enable a user to disassemble the training aid 10. This provides the benefit of portability and allowing the user to erect the training aid 10 in a one location, disassemble the training aid 10 for transportation, and then re-erect the training aid 10 in a different location.

I claim:

1. A swing training apparatus comprising:

reflective means for viewing a reflection image, said reflective means being break-resistant;

support means for supporting said reflective means in a generally upright initial position so that a user can see himself and to automatically return said reflective means back to said initial position after said reflective means is impacted by a projectile; and a base portion comprising a generally planar baseboard, a generally U-shaped mirror reception portion disposed at a front end of said baseboard, and a frame support block disposed upon said baseboard near the end opposite to said front end;

wherein said support means is removably coupled to said reflective means and said reflective means and said support means are both removably couple said base portion.

2. The swing training apparatus of claim 1 wherein said support means includes a pair of tubular generally L-shaped members, wherein each of said L-shaped members include a first generally vertical leg member which is coupled to said base portion and a second generally horizontal leg member which is coupled to said reflective means.

3. The swing training apparatus of claim 2 wherein said support means is comprised of polyvinyl chloride.

4. The swing training apparatus of claim 2 wherein said second leg member projects from said first leg member at an angle ranging from 90 degrees to 110 degrees.

5. The swing training apparatus of claim 1 wherein said reflective means includes:

a clear and thin front layer of acrylic material which is generally planar;

a supportive backing layer which is generally planar; and a reflective layer disposed between said front layer and said backing layer;

wherein a potion of said backing layer extends beyond said front layer and said reflective layer.

6. The swing training apparatus of claim 5 wherein said reflective means includes at least one alignment line across said front layer.

7. The swing training apparatus of claim 1 further comprising a ramp member which is removably coupled to said reflective means and is oriented sloping away from said reflective means.

8. The swing training apparatus of claim 1 further comprising a net means which hangs between a user and said reflective means and is effective to block any balls which are directed in its direction by a user.

9. The swing training apparatus of claim 8 wherein said net means includes:

a pair of L-shaped uprights, each having a support end and a crossbar mating end;

an elongated crossbar which is removably coupled to each of said crossbar mating ends;

and a net which is coupled to and is suspended from said crossbar;

wherein said L-shaped uprights are removably coupled at their support ends to said reflective means so that said crossbar and said net are disposed in front of said reflective means.

10. The swing training apparatus of claim 7 further comprising a net means which hangs between a user and said reflective means and is effective to block any balls which are directed in its direction by a user.

11. The swing training apparatus of claim 10 wherein said net means includes:

a pair of L-shaped uprights, each having a support end and a crossbar mating end;

an elongated crossbar which is removably coupled to each of said crossbar mating ends;

and a net which is coupled to and is suspended from said crossbar;

wherein said L-shaped uprights are removably coupled at their support ends to said reflective means so that said crossbar and said net are disposed in front of said reflective means.

12. A swing training apparatus for improving a user's swing user; memory, said training apparatus comprising;

a mirror assembly including:

a thin acrylic front layer;

a reflective layer which is sized to provide a full body reflection of a user;

a resilient planar backing layer, wherein said front layer and said reflective layer are fixedly coupled to a front side of said backing layer, whereby said front layer covers said reflective layer;

a first support block which is coupled to a back side of said backing layer; and an accessory rail which is coupled to said front side of said backing layer beneath said front layer;

a base portion including:

a generally planar baseboard having a front end and a back end;

a second support block which is disposed upon said baseboard close to said back end of said baseboard; and a pair of mirror support rails which are disposed upon said baseboard close to said front end, said mirror support rails cooperate with said baseboard to define a mirror reception channel;

a frame assembly including a pair of relatively rigid, elongated, and L-shaped tubular frame members, each having a horizontally oriented first leg portion and a vertically oriented second leg portion:

wherein a bottom portion of said mirror assembly is disposed within said U-shaped channel and said first leg portions are removably coupled to said first support block and said second lea portions are removably coupled to said second support block to orient said mirror assembly in a generally upright position.

13. The swing training apparatus of claim 12 wherein said mirror assembly is approximately two feet wide, four feet long, and one-half inch thick;

wherein said baseboard is approximately two feet wide and four feet long and is comprised of a wood material;

wherein said frame assembly is comprised of polyvinyl chloride; and wherein said first leg portion has an approximate outside diameter of one inch and is approximately three feet long and said second leg portion has an approximate outside diameter of one inch and is approximately two feet long.

14. The swing training apparatus of claim 12 further comprising:

an elongated ramp member comprised of wood, said ramp member having a green artificial turn covering over its top surface;

wherein said ramp member is generally planar in construction and is removably coupled to said accessory rail projecting away from said mirror assembly and angling down from said accessory rail toward the ground.

15. The swing training apparatus of claim 12 further comprising a net assembly, said net assembly including:

a netting frame having two relatively rigid, elongated, and L-shaped tubular frame members, each having a horizontally oriented third lea portion and a vertically oriented fourth leg portion, said fourth legs are removably coupled to said first support block;

an elongated crossbar of tubular construction, said crossbar being removably coupled to each of said third leg portions whereby said crossbar runs generally perpendicular to said fourth leg portions; and a relatively fine mesh net which is suspended from and runs the length of said crossbar.

16. The swing training apparatus of claim 15 wherein said netting frame and said crossbar are comprised of polyvinyl chloride;

wherein said third leg portions are approximately eighteen inches long and one inch in outside diameter;

wherein said fourth leg portions are approximately three feet long and one inch in outside diameter;

wherein said crossbar is approximately four feet long and one inch in diameter; and wherein said net is approximately four feet wide and six feet long.

17. The swing training apparatus of claim 12 further comprising at least one alignment line which traverses said front layer.

18. The swing training apparatus of claim 17 further comprising a plurality of tie-down hooks disposed along the length of said back side of said backing layer, wherein said at least one alignment line comprises at least one string which is tied to said tie-down hooks.

19. A swing training apparatus for improving a users swing muscle memory, said training apparatus comprising:

a mirror assembly including:

a thin acrylic front layer having at least one alignment lines;

a reflective layer which is sized to provide a full body reflection of a user;

a resilient planar backing layer, wherein said front layer and said reflective layer are fixedly coupled to a front side of said backing layer, whereby said front layer covers said reflective layer;

a first support block which is coupled to a back side of said backing layer; and an accessory rail which is coupled to said front side of said backing layer beneath said front layer;

a base portion including:

a generally planar baseboard having a front end and a back end;

a second support block which is disposed upon said baseboard near said back end of said baseboard; and a pair of mirror support rails which are disposed upon said baseboard near said front end of said baseboard, said mirror support rails cooperate with said baseboard to define a mirror reception channel;

a frame assembly including a pair of relatively rigid, elongated, and L-shaped tubular frame members, each having a horizontally oriented first leg portion and a vertically oriented second leg portion:

an elongated ramp member comprised of wood, said ramp member having a green artificial turn covering over its top surface;

a netting frame having two relatively rigid, elongated, and L-shaped tubular frame members, each having a horizontally oriented third leg portion and a vertically oriented fourth leg portion;

an elongated crossbar of tubular construction, said crossbar being removably coupled to each of said third leg portions whereby said crossbar runs generally perpendicular to said fourth leg portions; and a relatively fine mesh net which is suspended from and runs the length of said crossbar;

wherein a bottom portion of said mirror assembly is disposed within said U-shaped channel and said first leg portions are removably coupled to said first support block and said second leg portions are removably coupled to said second support block to orient said mirror assembly in a generally upright position;

wherein said ramp member is generally planar in construction and is removably coupled to said accessory rail projecting away from said mirror assembly and angling down from said accessory rail toward the ground.

* * * * *